US010920305B2

(12) United States Patent
Omori et al.

(10) Patent No.: US 10,920,305 B2
(45) Date of Patent: Feb. 16, 2021

(54) FE-BASED SHAPE MEMORY ALLOY MATERIAL AND METHOD OF PRODUCING THE SAME

(71) Applicants: TOHOKU UNIVERSITY, Sendai (JP); FURUKAWA TECHNO MATERIAL CO., LTD., Hiratsuka (JP); FURUKAWA ELECTRIC CO., LTD., Tokyo (JP)

(72) Inventors: Toshihiro Omori, Sendai (JP); Ryosuke Kainuma, Sendai (JP); Yuki Noguchi, Sendai (JP); Sumio Kise, Hiratsuka (JP); Toyonobu Tanaka, Hiratsuka (JP)

(73) Assignees: TOHOKU UNIVERSITY, Sendai (JP); FURUKAWA TECHNO MATERIAL CO., LTD., Hiratsuka (JP); FURUKAWA ELECTRIC CO., LTD., Tokyo (JP)

( * ) Notice: Subject to any disclaimer, the term of this patent is extended or adjusted under 35 U.S.C. 154(b) by 76 days.

(21) Appl. No.: 16/252,215

(22) Filed: Jan. 18, 2019

(65) Prior Publication Data

US 2019/0153571 A1 May 23, 2019

Related U.S. Application Data

(63) Continuation of application No. PCT/JP2017/031855, filed on Sep. 5, 2017.

(30) Foreign Application Priority Data

Sep. 6, 2016 (JP) ..... 2016-174142

(51) Int. Cl.
*C22C 30/00* (2006.01)
*C22C 38/58* (2006.01)
(Continued)

(52) U.S. Cl.
CPC ..... *C22C 30/00* (2013.01); *C21D 6/004* (2013.01); *C21D 6/005* (2013.01); *C21D 8/0273* (2013.01);
(Continued)

(58) Field of Classification Search
None
See application file for complete search history.

(56) References Cited

U.S. PATENT DOCUMENTS

2001/0023723 A1 9/2001 Kikuchi et al.
2005/0236077 A1* 10/2005 Kikuchi ..... C22C 38/12 148/563
(Continued)

FOREIGN PATENT DOCUMENTS

CN 1180112 C 12/2004
CN 101215678 A 7/2008
(Continued)

OTHER PUBLICATIONS

International Search Report, issued in PCT/JP2017/031855, dated Dec. 12, 2017.
(Continued)

*Primary Examiner* — George Wyszomierski
(74) *Attorney, Agent, or Firm* — Birch, Stewart, Kolasch & Birch, LLP

(57) ABSTRACT

A Fe-based shape memory alloy material, containing 25 atom % to 42 atom % of Mn, 9 atom % to 13 atom % of Al, 5 atom % to 12 atom % of Ni, and 5.1 atom % to 15 atom % of Cr, with the balance being Fe and unavoidable impurities; a method of producing the same; and a wire material and sheet material composed of the alloy material.

8 Claims, 3 Drawing Sheets

(51) Int. Cl.

| | |
|---|---|
| ***C22C 38/00*** | (2006.01) |
| ***C21D 8/02*** | (2006.01) |
| ***C21D 8/06*** | (2006.01) |
| ***C21D 6/00*** | (2006.01) |
| ***C21D 9/46*** | (2006.01) |
| ***C21D 9/52*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/50*** | (2006.01) |
| ***C22C 38/52*** | (2006.01) |
| ***C22C 38/54*** | (2006.01) |
| *C21D 6/02* | (2006.01) |

(52) U.S. Cl.

CPC ..... *C21D 8/065* (2013.01); *C21D 9/46* (2013.01); *C21D 9/525* (2013.01); *C22C 38/00* (2013.01); *C22C 38/02* (2013.01); *C22C 38/06* (2013.01); *C22C 38/44* (2013.01); *C22C 38/46* (2013.01); *C22C 38/50* (2013.01); *C22C 38/52* (2013.01); *C22C 38/54* (2013.01); *C22C 38/58* (2013.01); *C21D 6/007* (2013.01); *C21D 6/008* (2013.01); *C21D 6/02* (2013.01); *C21D 2201/01* (2013.01)

(56) References Cited

U.S. PATENT DOCUMENTS

| | | | | |
|---|---|---|---|---|
| 2010/0139813 | A1 | 6/2010 | Ozaki | |
| 2012/0199253 | A1 | 8/2012 | Ishida et al. | |
| 2016/0145708 | A1* | 5/2016 | Fechte-Heinen | C22C 38/42 148/541 |

FOREIGN PATENT DOCUMENTS

| | | | |
|---|---|---|---|
| CN | 102936701 | A | 2/2013 |
| CN | 103866211 | A | 6/2014 |
| CN | 105154751 | A | 12/2015 |
| EP | 0 176 272 | A1 | 4/1986 |
| EP | 2141251 | A1 | 1/2010 |
| EP | 2489752 | A1 | 8/2012 |
| JP | 62-170457 | A | 7/1987 |
| JP | 2-228451 | A | 9/1990 |
| JP | 2000-17395 | A | 1/2000 |
| JP | 2001-226747 | A | 8/2001 |
| JP | 2003-268501 | A | 9/2003 |
| JP | 2005-290397 | A | 10/2005 |
| JP | 2010-156041 | A | 7/2010 |
| JP | 2011-46055 | A | 3/2011 |
| JP | 5005834 | B2 | 8/2012 |
| JP | 2013-87908 | A | 5/2013 |
| JP | 2015-163725 | A | 9/2015 |
| WO | WO 2009/102999 | A1 | 8/2009 |
| WO | WO 2011/046055 | A1 | 4/2011 |

OTHER PUBLICATIONS

"Fe—Cr—Ni—Mn—Si," Aerospace Materials & Technology, 1994, pp. 1-13, 6 pages total, with an English abstract.

Chinese Office Action and Search Report for corresponding Chinese Application No. 201780043343.8, dated May 8, 2020, with an English translation.

Guerrero et al., "Composition effects on the fcc-hcp martensitic transformation and on the magnetic ordering of the fcc structure in Fe—Mn—Cr alloys," Materials and Design, vol. 116, 2017, pp. 127-135, 9 pages total.

Extended European Search Report for corresponding European Application No. 17848727.8, dated Apr. 28, 2020.

* cited by examiner

FE-BASED SHAPE MEMORY ALLOY MATERIAL AND METHOD OF PRODUCING THE SAME

CROSS-REFERENCE TO RELATED APPLICATIONS

This application is a Continuation of PCT International Application No. PCT/JP2017/031855 filed on Sep. 5, 2017, which claims priority under 35 U.S.C. § 119 (a) to Japanese Patent Application No. 2016-174142 filed in Japan on Sep. 6, 2016. Each of the above applications is hereby expressly incorporated by reference, in its entirety, into the present application.

TECHNICAL FIELD

The present invention relates to a Fe-based shape memory alloy material and a method of producing the same. More particularly, the present invention relates to a Fe-based shape memory alloy material having excellent shape memory effect in a temperature range for practical use and excellent superelasticity characteristics, and to a method of producing the same.

BACKGROUND ART

Regarding shape memory alloys, practicalization is underway in order to utilize the specific functions of the alloys in the fields of various industries, medicine, and the like. Known examples of shape memory alloys exhibiting a shape memory phenomenon or a superelasticity phenomenon (which may be also referred to as pseudo-elasticity phenomenon) include: non-ferrous metal-based alloys, such as a Ni—Ti-based alloy, a Ni—Al-based alloy, a Cu—Zn—Al-based alloy, and a Cu—Al—Ni-based alloy; and ferrous metal-based alloys, such as a Fe—Ni—Co—Ti-based alloy, a Fe—Mn—Si-based alloy, a Fe—Ni—C-based alloy, and a Fe—Ni—Cr-based alloy.

Ti—Ni-based alloys have excellent shape memory effect and excellent superelasticity characteristics, and they are practically utilized in medical guide wires, spectacles, and the like. However, since Ti—Ni-based alloys are poor in workability and are expensive, use applications thereof are limited.

Ferrous metal-based alloys have advantages, such as low raw material cost and exhibition of magnetism; application of the ferrous metal-based alloys in various fields can be expected as long as more practical shape memory effect and superelasticity characteristics can be exhibited. However, ferrous metal-based shape memory alloys have various problems that have not yet been solved. For example, Fe—Ni—Co—Ti-based alloys exhibit shape memory characteristics due to stress-induced transformation; however, the Ms point (martensitic transformation initiation temperature) is as low as 200 K or lower. Fe—Ni—C-based alloys have carbides produced upon reversible transformation, and therefore, the shape memory characteristics become poorer. Fe—Mn—Si-based alloys exhibit relatively satisfactory shape memory characteristics; however, these alloys have poor cold-workability and insufficient corrosion resistance, and do not exhibit superelasticity characteristics.

Patent Literature 1 discloses a Fe—Ni—Si-based shape memory alloy composed of 15% to 35% by weight of Ni and 1.5% to 10% by weight of Si, with the balance being Fe and unavoidable impurities. Further, Patent Literature 2 discloses a Fe—Ni—Al-based shape memory alloy composed of 15% to 40% by mass of Ni and 1.5% to 10% by mass of Al, with the balance being Fe and unavoidable impurities. These alloys have a microstructure in which the γ' phase of $L1_2$ structure has precipitated in the γ phase of the FCC structure.

Patent Literature 3 discloses a ferrous metal-based shape memory alloy composed of 15% to 40% by weight of Mn, 1% to 20% by weight of Co, and/or 1% to 20% by weight of Cr, and 15% by weight or less of at least one selected from Si, Al, Ge, Ga, Nb, V, Ti, Cu, Ni, and Mn, with the balance being iron. It is described that Co, Cr, or Si noticeably lowers the magnetic transformation point (Neel point) but hardly changes the γ→ε martensitic transformation temperature.

Patent Literature 4 discloses a Fe-based shape memory alloy containing 25 atom % to 42 atom % of Mn, 12 atom % to 18 atom % of Al, and 5 atom % to 12 atom % of Ni, with the balance being Fe and unavoidable impurities. This alloy may further include 0.1 atom % to 5 atom % of Cr. It is described that this alloy provides high shape memory characteristics and high superelasticity characteristics.

CITATION LIST

Patent Literatures

Patent Literature 1: JP-A-2000-17395
Patent Literature 2: JP-A-2003-268501
Patent Literature 3: JP-A-62-170457 (1987)
Patent Literature 4: Japanese Patent No. 5005834

SUMMARY OF INVENTION

Technical Problem

However, regarding the alloys described in Patent Literature 1 and Patent Literature 2, the shape memory effect and the superelasticity characteristics are not practically sufficient, and improvement is desired. Regarding the alloy described in Patent Literature 3, the superelasticity characteristics are almost not exhibited, the shape memory effect is also practically insufficient, and further improvement is desired. Furthermore, regarding the alloy described in Patent Literature 4, further improvements on temperature dependency and oxidation resistance of the alloy are desired.

Thus, the present invention is contemplated for providing a Fe-based shape memory alloy material having excellent workability, excellent superelasticity and shape memory effect, markedly low temperature dependency, and excellent oxidation resistance.

Solution to Problem

The inventors of the present invention have conducted a thorough investigation in order to solve the problems described above. As a result, we have found: that an alloy obtained by adding certain amounts of Mn and Al to Fe undergoes martensitic transformation; that the resultant alloy exhibits shape memory characteristics when Ni is added to the alloy; and that when a certain amount of Cr is added to the alloy, the resultant alloy acquires: markedly lowered temperature dependency, and excellent oxidation resistance. The present invention is completed based on these findings.

That is, the present invention is to provide the following means:

(1) A Fe-based shape memory alloy material, containing 25 atom % to 42 atom % of Mn, 9 atom % to 13 atom % of Al, 5 atom % to 12 atom % of Ni, and 5.1 atom % to 15 atom % of Cr, with the balance being Fe and unavoidable impurities.

(2) The Fe-based shape memory alloy material according to item (1), further containing at least one element selected from the group consisting of 0.1 atom % to 5 atom % of Si, 0.1 atom % to 5 atom % of Ti, 0.1 atom % to 5 atom % of V, 0.1 atom % to 5 atom % of Co, 0.1 atom % to 5 atom % of Cu, 0.1 atom % to 5 atom % of Mo, 0.1 atom % to 5 atom % of W, 0.001 atom % to 1 atom % of B, and 0.001 atom % to 1 atom % of C, at an amount of 15 atom % or less in total.

(3) The Fe-based shape memory alloy material according to item (1) or (2), in which a temperature dependency of a transformation-induced stress is 0.30 MPa/° C. or lower.

(4) The Fe-based shape memory alloy material according to any one of items (1) to (3), having excellent high-temperature oxidation resistance.

(5) A method of producing the Fe-based shape memory alloy material according to any one of items (1) to (4), the method including a step of performing a solution treatment at 1,100° C. to 1,300° C.

(6) The method of producing the Fe-based shape memory alloy material according to item (5), further including a step of performing an aging treatment at 100° C. to 350° C. after the solution treatment step.

(7) A wire material formed from the Fe-based shape memory alloy material according to any one of items (1) to (4), in which an average grain size of the Fe-based shape memory alloy material is greater than or equal to a radius of the wire material.

(8) A sheet material formed from the Fe-based shape memory alloy material according to any one of items (1) to (4), in which an average grain size of the Fe-based shape memory alloy material is greater than or equal to a thickness of the sheet material.

Effects of Invention

The Fe-based shape memory alloy material of the present invention has excellent workability, high shape memory effect, and high superelasticity characteristics, while the material cost is relatively low. Furthermore, the alloy material has markedly low temperature dependency and excellent oxidation resistance, and therefore, the alloy material can be applied to various fields for various purposes.

Other and further features and advantages of the invention will appear more fully from the following description, appropriately referring to the accompanying drawings.

BRIEF DESCRIPTION OF THE DRAWINGS

FIG. 3(*b*) is a schematic diagram illustrating another example of the grain size of the wire material of the present invention.

MODE FOR CARRYING OUT THE INVENTION

[1] Fe-Based Shape Memory Alloy Material

Figure 1:
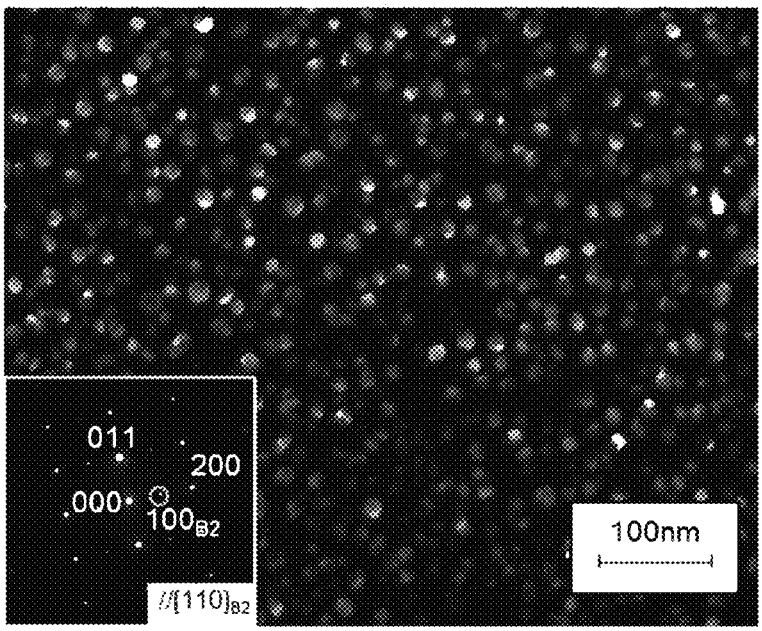
FIG. 1 is a TEM photograph showing a dark viewing-field image and a selected viewing-field (area) diffraction pattern obtained from the (100) plane B2 of No. 7 Fe-based shape memory alloy material produced in Example 1.

Fe-based shape memory alloy materials of various embodiments of the present invention will be described in detail below; however, unless particularly stated otherwise, the explanation for each of the embodiments is also applicable to other embodiments. Furthermore, in the present specification, unless particularly stated otherwise, the content of each element is based on the entire alloy material (100 atom %).

(1) Composition

The Fe-based shape memory alloy material of the present invention contains 25 atom % to 42 atom % of Mn, 9 atom % to 13 atom % of Al, 5 atom % to 12 atom % of Ni, and 5.1 atom % to 15 atom % of Cr, with the balance being Fe and unavoidable impurities.

The Fe-based shape memory alloy material of the present invention may further contain at least one selected from the group consisting of 0.1 atom % to 5 atom % of Si, 0.1 atom % to 5 atom % of Ti, 0.1 atom % to 5 atom % of V, 0.1 atom % to 5 atom % of Co, 0.1 atom % to 5 atom % of Cu, 0.1 atom % to 5 atom % of Mo, 0.1 atom % to 5 atom % of W, 0.001 atom % to 1 atom % of B, and 0.001 atom % to 1 atom % of C, at an amount of 15 atom % or less in total (the at least one element selected from the group consisting of these Si, Ti, V, Co, Cu, Mo, W, B, and C will be hereinafter referred to as fifth component element).

Mn is an element that accelerates the formation of a martensitic phase. By regulating the content of Mn, the initiation temperature (Ms) and completion temperature (Mf) of martensitic transformation, the initiation temperature (As) and completion temperature (Af) of reversible martensitic transformation, and Curie temperature (Tc) can be changed. When the content of Mn is less than 25 atom %, the BCC structure of the parent phase (matrix) may become too stable and may not undergo martensitic transformation. On the other hand, when the content of Mn is more than 42 atom %, the parent phase may not have the BCC structure. The content of Mn is preferably 30 atom % to 38 atom %, and more preferably 34 atom % to 36 atom %.

Al is an element that accelerates the formation of a parent phase having the BCC structure. When the content of Al is less than 9 atom %, the parent phase acquires the fcc structure. On the other hand, when the content of Al is more than 13 atom %, the BCC structure becomes too stable and does not undergo martensitic transformation. The content of Al is preferably 9.5 atom % to 12.5 atom %, and more preferably 10.5 atom % to 11.5 atom %.

Ni is an element that precipitates an ordered phase in the parent phase and thereby enhances the shape memory characteristics. When the content of Ni is less than 5 atom %, the shame memory characteristics are not sufficient. On the other hand, when the content of Ni is more than 12 atom %, ductility is lowered. The content of Ni is preferably 5 atom % to 10 atom %, and more preferably 6 atom % to 8 atom %.

When an appropriate amount of Cr is incorporated, corrosion resistance can be enhanced. Also, by regulating the content of Cr, the change in transformation entropy can be lowered, and temperature dependency can be lowered.

When the content of Cr is less than 5.1 atom %, there is no change in the transformation entropy. On the other hand, when the content of Cr is more than 15 atom %, the parent phase acquires the FCC structure. The content of Cr is preferably 6.0 atom % to 12.0 atom %, and more preferably 7.5 atom % to 10.0 atom %.

Fe is an element that enhances the shape memory characteristics and magnetic characteristics. When the Fe content is insufficient, the shape memory characteristics are lost, and even if the content is excessive, the shape memory characteristics are not exhibited. In order to obtain excellent shape memory characteristics and ferromagnetism, the content of Fe is preferably 35 atom % to 50 atom %, and more preferably 40 atom % to 46 atom %.

When at least one element selected from the group consisting of Si, Ti, V, Co, Cu, Mo, W, B, and C is incorporated at an amount of 15 atom % or less in total, the shape memory characteristics, ductility, and corrosion resistance can be enhanced, and by regulating the content of those elements, Ms and Tc can be changed. Furthermore, Co has an action of enhancing the magnetic characteristics. When the total content of these elements is more than 15 atom %, there is a risk that the resultant alloy may be embrittled. The total content of these elements is preferably 10 atom % or less, and more preferably 6 atom % or less. From the viewpoint of the shape memory characteristics, it is preferable to select the element from the group consisting of Si, Ti, V, Cu, Mo, W, B, and C.

(2) Microstructure

The Fe-based shape memory alloy material of the present invention undergoes martensitic transformation from the parent phase (a phase) of the BCC structure. In a temperature range higher than the Ms, the alloy material has a parent phase structure having the BCC structure, and in a temperature range lower than the Mf, the alloy material has a martensitic phase structure. In order to exhibit excellent shape memory characteristics, the parent phase is preferably such that an ordered phase (B2 or $L2_1$) has finely precipitated in the A2 phase having a disordered BCC structure, and it is preferable that the ordered phase is the B2 phase. It is acceptable that a small amount of the γ phase having the FCC structure is precipitated in the parent phase. The γ phase contributes to the enhancement of ductility by precipitating mainly around grain boundaries upon cooling after solution treatment or by precipitating at the solution treatment temperature; however, when the γ phase appears in a large quantity, the shape memory characteristics may be impaired. In the case of precipitating the γ phase in the parent phase for ductility enhancement, the volume fraction is preferably 10% or less, and more preferably 5% or less. The crystal structure of the martensitic phase is a long period structure of 2 M, 8 M, 10 M, 14 M, or the like. The Fe-based shape memory alloy material may be composed of a single crystal that does not have grain boundaries between α phases.

The Fe-based shape memory alloy material is such that the parent phase having the BCC structure is ferromagnetic, while the martensitic phase is paramagnetic, antiferromagnetic, or more weakly ferromagnetic than the parent phase.

[2] Production Method

The Fe-based shape memory alloy material can be produced, in usual manners, via forming the alloy material into a desired shape by melt-casting, forging, hot-working (hot-rolling, or the like), cold-working (cold-rolling, wire-drawing, or the like), press-working, and the like, and then subjecting the thus-formed alloy material to a solution treatment at a particular temperature. For example, the casting temperature can be set to 1,500° C. to 1,600° C., the hot-working temperature can be set to about 1,200° C., the hot-working ratio can be set to 87% or higher, and the cold-rolling ratio can be set to 30% or higher.

Furthermore, in a usual manner, it is also possible to produce a sintered body by sintering a powder, or to produce a thin film by rapid solidification, sputtering, or the like.

In regard to melt-casting, hot-working, sintering, film-forming, and the like, use may be made of any of methods similar to the methods used in the case of general shape memory alloys. Since the Fe-based shape memory alloy material has excellent workability, the alloy material can be formed easily into various shapes, such as extra fine wires and foils, by cold-working or cutting-and-machining.

The production process essentially includes a step of performing a solution treatment. The solution treatment is carried out by heating a Fe-based shape memory alloy material that has been formed, by melt-casting, hot- and cold-rolling, or the like, to a solid-solution temperature, converting the microstructure into a parent phase (BCC phase), and then rapidly cooling the same. It is preferable that the solution treatment is carried out at 1,100° C. to 1,300° C., and it is more preferable that the solution treatment is carried out at 1,200° C. to 1,250° C. The retention time at the solid-solution temperature may be 1 minute or longer; however, if the retention time is longer than 60 minutes, the influence of oxidation cannot be neglected. Therefore, it is preferable that the retention time is 1 to 60 minutes. The cooling speed is preferably 200° C./sec or higher, and more preferably 500° C./sec or higher. Cooling is carried out by immersing the alloy material in a coolant, such as water, or by forced air-cooling.

Satisfactory shape memory characteristics are obtainable even through the solution treatment only; however, it is preferable to further perform an aging treatment at 100° C. to 350° C. after the solution treatment. An aging treatment is effective for an enhancement and stabilization of the shape memory characteristics. The temperature of the aging treatment is more preferably 150° C. to 250° C. The aging treatment time may vary depending on the composition and treatment temperature of the Fe-based shape memory alloy material; however, the aging treatment time is preferably 5 minutes or longer, and more preferably 30 minutes to 24 hours. When the aging treatment time is less than 5 minutes, the effect is insufficient, and, on the other hand, when the aging treatment time is too long (for example, several hundred hours), ductility is lowered.

[3] Characteristics (1) Shape Memory Characteristics

In regard to a Fe-based shape memory alloy material having a higher As than the temperature range for practical use, since the state of the martensitic phase is stable in the temperature range for practical use, the alloy material stably exhibits satisfactory shape memory characteristics. The shape recovery ratio [=100×(received strain−residual strain)/received strain] of the Fe-based shape memory alloy material is about 90% or higher, and substantially 100%.

(2) Superelasticity and Temperature Dependency Thereof

A Fe-based shape memory alloy material having a lower Af than the temperature range for practical use exhibits stable and satisfactory superelasticity in a temperature range for practical use. Usually, even at a received strain of 6% to 8%, the shape recovery ratio after relaxation of deformation is 95% or higher.

Furthermore, usual shape memory alloys have a property that when the temperature elevates, the martensitic transformation-induced stress becomes higher. However, since the Fe-based shape memory alloy material of the present invention has markedly low temperature dependency of the martensitic transformation-induced stress and exhibits a markedly small change in the deformation stress caused by the environment temperature, the Fe-based shape memory alloy material is preferable for practical use. For example, while the temperature dependency of the martensitic transformation-induced stress in Ni—Ti shape memory alloys is about 5 MPa/° C., and the temperature dependency in Fe—Mn—Al—Ni-5.0Cr shape memory alloy materials is about 0.35 MPa/° C., the temperature dependency of the martensitic transformation-induced stress in the Fe-based shape memory alloy material of the present invention is 0.30 MPa/° C. or less. The reason why the temperature dependency of the transformation-induced stress is noticeably low may be such that in the Fe-based shape memory alloy material of the present invention, the change in the transformation entropy is markedly small.

Since the temperature dependency of the transformation-induced stress is noticeably low, the Fe-based shape memory alloy material of the present invention is particularly preferable, for example, for outdoors applications, such as construction materials and automobiles. This is because the Fe-based shape memory alloy material can exhibit superelasticity characteristics even in an environment at a temperature of, for example, from −50° C. to 150° C.

Figure 2:
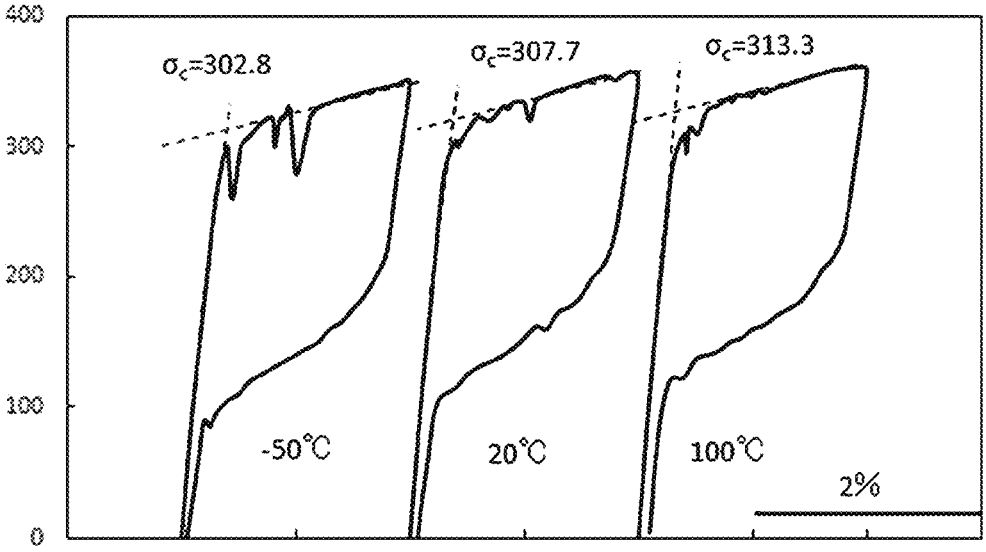
FIG. 2 is a graph showing a stress-strain curve for evaluating the shape memory characteristics of No. 7 Fe-based shape memory alloy material produced in Example 1 at various temperatures of −50° C., 20° C., and 100° C.

Meanwhile, regarding the temperature dependency of the Fe-based shape memory alloy material of the present invention, the shape memory characteristics at various temperatures, such as −50° C., 20° C., and 100° C., were evaluated. The results are shown in FIG. 2. The martensitic transformation-induced stress was defined as the stress to reach a stress plateau.

As is apparent from FIG. 2, the shape recovery ratio was almost not dependent on the test temperature and was very satisfactory at any temperature. Furthermore, regarding the martensitic transformation-induced stress, similarly, no large difference caused by temperature was observed. In usual shape memory alloy materials, the martensitic transformation-induced stress changes greatly depending on the temperature, and, for example, in Ti—Ni shape memory alloys, the temperature dependency of the martensitic transformation-induced stress is about 5 MPa/° C. On the contrary to the above, in the Fe-based shape memory alloy material of the present invention, as is apparent from the stress-strain diagram of FIG. 2, the change in stress with respect to temperature was very small, and the temperature dependency of the martensitic transformation-induced stress was 0.30 MPa/° C. or less. That is, it was found that with regard to the Fe-based shape memory alloy material of the present invention, the mechanical strength is not likely to be affected by temperature in a wide temperature range from below room temperature to high temperature.

(3) Workability

Since the Fe-based shape memory alloy material of the present invention has satisfactory hardness, tensile strength, and break elongation, the Fe-based shape memory alloy material exhibits excellent workability.

[4] Members Formed from Fe-Based Shape Memory Alloy Material

Since the Fe-based shape memory alloy material is rich in hot-workability and cold-workability and can be subjected to cold-working at a maximum working ratio of about 30% to 99%, the Fe-based shape memory alloy material can be easily formed into extra fine wires, foils, springs, pipes, and the like.

The shape memory characteristics of the Fe-based shape memory alloy material are largely dependent on the crystal structure as well as the size of the grains. For example, in the case of a wire material or a sheet material, when the average grain size of the grains is larger than or equal to the radius R of the wire material or the thickness T of the sheet material, the shape memory effect and superelasticity are largely enhanced. This is speculated to be because, as shown in FIG. 3(*a*), FIG. 3(*b*), and FIG. 4, when the average grain size of the grains is larger than or equal to the radius R of the wire material or the thickness T of the sheet material, the binding force between the grains is lowered.

(1) Wire Material

Figure 3A:
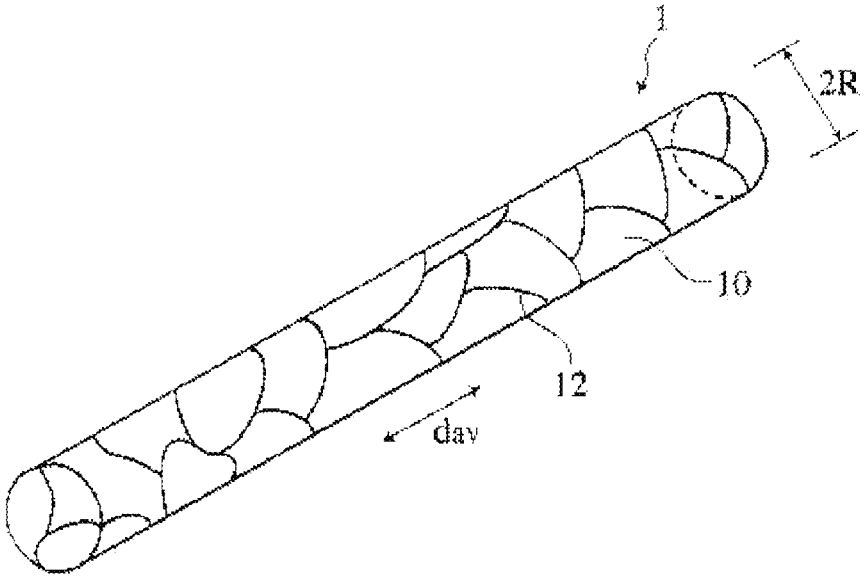
FIG. 3(*a*) is a schematic diagram illustrating an example of the grain size of the wire material of the present invention.
Figure 3B:
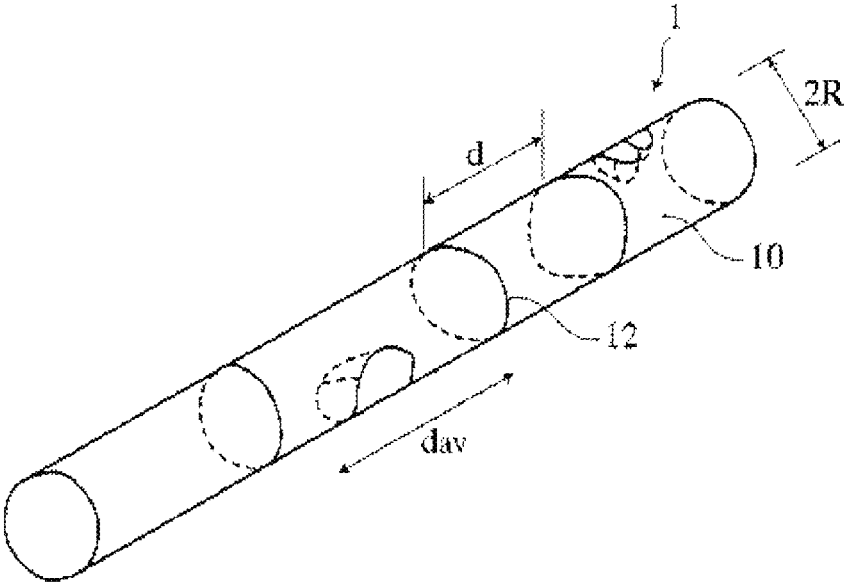

In regard to wire material 1 formed from the Fe-based shape memory alloy material, the average grain size dav of the grains 10 is preferably larger than or equal to the radius R of the wire material 1 (FIG. 3(*a*)), and more preferably larger than or equal to the diameter 2R (FIG. 3(*b*)). When the average grain size dav satisfies the condition of dav≥2R, the wire material has a structure in which the grain boundaries 12 are positioned like joints of bamboo. Thus, binding between the grains is markedly lowered, and the behavior becomes close to a single crystal-like behavior.

Even if the Fe-based shape memory alloy material satisfies the condition of dav≥R or dav≥2R, since the grains have a grain size distribution, grains having a grain size d that is smaller than the radius R also exist. Even if grains with d<R exist in a slight amount, the characteristics of the Fe-based shape memory alloy material are almost not affected. However, in order to obtain a Fe-based shape memory alloy material having satisfactory shape memory effect and superelasticity, it is preferable that the region in which the grain size d is larger than or equal to the radius R is 30% or more, and more preferably 60% or more, with respect to the entire length of the wire material 1.

The wire material 1 can be used for a guide wire for catheter, for example. In the case of a fine wire having a diameter of 1 mm or less, a plurality of wires may be twisted, to form a stranded wire. The wire material 1 can also be used as a spring material.

(2) Sheet Material

Figure 4:
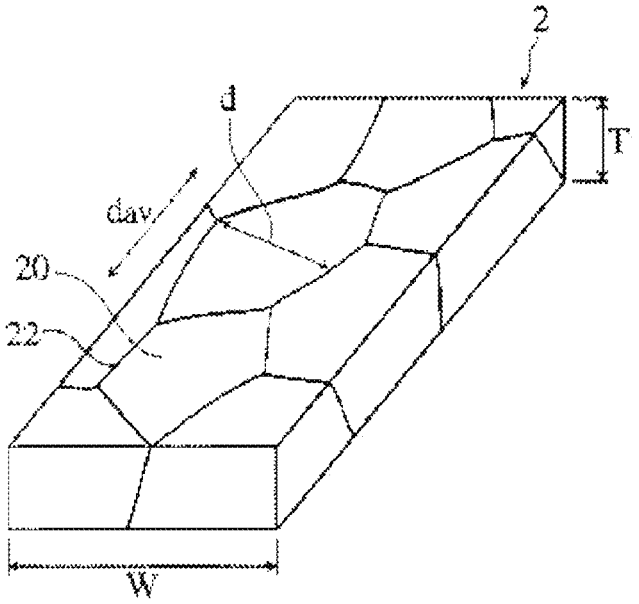
FIG. 4 is a schematic diagram illustrating an example of the grain size of the sheet material of the present invention.

In regard to a sheet material formed from the Fe-based shape memory alloy material, as illustrated in FIG. 4, it is preferable that the average grain size dav of the grains 20 is larger than or equal to the thickness T of the sheet material 2, and more preferably, dav≥2T. A sheet material 2 having such grains 20 is in a state in which individual grains 20 are opened from the grain boundaries 22 at the surface of the sheet material 2. In regard to a sheet material 2 that satisfies the condition of dav≥T, similarly to the wire material 1, since the binding force between the grains is lowered, the sheet material 2 exhibits excellent shape memory effect and superelasticity. The average grain size dav of the grains 20 is more preferably larger than or equal to the width W of the sheet material 2.

Similarly to the wire material 1, even if the condition of dav≥T or dav≥2T is satisfied, since the grains have a grain size distribution, grains having a grain size d that is smaller than the thickness T also exist. In order to obtain a Fe-based shape memory alloy material having more satisfactory shape memory effect and superelasticity, it is preferable that the region in which the grain size d is larger than or equal to the thickness T is 30% or more, and more preferably 60% or more, of the entire area of the sheet material 2.

The sheet material 2 can be used for various spring materials, contact members, clips, and the like, by utilizing the superelasticity of the material.

(3) Production Method

The wire material 1 can be produced by first producing a relatively thick wire material by hot-forging and drawing, then producing a wire material 1 having a finer diameter by a plurality of times of cold-working, such as cold-drawing (the maximum cold-working ratio: 30% or higher), then performing the above-described solution treatment at least once, and performing a quenching treatment and/or an aging treatment as necessary.

The sheet material 2 can be produced by performing a plurality of times of cold-rolling (the maximum cold-working ratio: 30% or higher) after hot-rolling, subjecting the thus-obtained sheet material to stamping and/or press-working into is a desired shape, performing the above-described solution treatment at least once, and performing a quenching treatment and/or an aging treatment as necessary. A foil can also be produced similarly to the case of the sheet material.

EXAMPLES

The present invention will be described in more detail based on examples given below, but the invention is not meant to be limited by these.

Example 1

(Solution-Treated Material)

Raw materials of various Fe-based alloy materials having the compositions shown in Table 1 were melt-forged (ϕ12 mm, about 30 g) using a high-frequency induction furnace, and were subjected to hot-rolling (1,200° C.) to a sheet thickness of 1 mm. Then, the thus hot-rolled sheets were subjected to cold-rolling to a sheet thickness of 0.25 mm, and the resultant sheets were cut out to a width of about 2 mm. The cut pieces were subjected to a solution treatment for 15 minutes at 1,300° C. in a vacuum, and then were quenched with water (water-cooling).

(Aging-Treated Material)

The various solution-treated materials were further subjected to an aging treatment at 200° C. for one hour.

TABLE 1

| Sample No. | Alloy composition (atom %) Mn | Al | Ni | Cr | Amount to add the fifth element | Balance | Remarks |
|---|---|---|---|---|---|---|---|
| 1 | 34.0 | 15.0 | 7.5 | — | — | Fe | CE |
| 2 | 34.0 | 14.5 | 7.5 | 1.0 | — | " | " |
| 3 | 34.0 | 14.0 | 7.5 | 2.0 | — | " | " |
| 4 | 34.0 | 13.5 | 7.5 | 3.0 | — | " | " |
| 5 | 34.0 | 12.5 | 7.5 | 5.1 | — | " | This Inv. |
| 6 | 34.0 | 11.4 | 7.5 | 5.4 | — | " | " |
| 7 | 34.0 | 11.3 | 7.5 | 7.5 | — | " | " |
| 8 | 34.0 | 10.0 | 7.5 | 10.0 | — | " | " |
| 9 | 34.0 | 10.0 | 7.5 | 12.5 | — | " | " |
| 10 | 32.5 | 9.0 | 7.5 | 15.0 | — | " | " |
| 11 | 33.5 | 10.8 | 7.5 | 7.5 | Si: 1.0 | " | " |
| 12 | 33.0 | 10.3 | 7.5 | 7.5 | Ti: 2.0 | " | " |
| 13 | 33.0 | 10.3 | 7.5 | 7.5 | V: 2.0 | " | " |
| 14 | 33.0 | 10.3 | 7.5 | 7.5 | Co: 2.0 | " | " |
| 15 | 33.0 | 10.3 | 7.5 | 7.5 | Mo: 2.0 | " | " |
| 16 | 33.5 | 10.8 | 7.5 | 7.5 | W: 1.0 | " | " |
| 17 | 34.0 | 11.2 | 7.5 | 7.5 | B: 0.1 | " | " |
| 18 | 34.0 | 11.1 | 7.5 | 7.5 | C: 0.2 | " | " |

Note:
'This Inv.' means this invention: and 'CE' means comparative example. The same will be applied in below.

The superelasticity characteristics were tested and evaluated by a tensile test, in a state of having loading and unloading repeatedly performed. The sample size was set to 2 mm×1 mm×60 mm, and the gauge length was set to 30 mm. The superelasticity characteristics were determined by the following formula. The prestrain amount was 2% in all cases, and the tensile test was performed after the aging heat treatment.

$$\text{Superelasticity recovery ratio (\%)}=\{(\text{Prestrain amount}-\text{strain amount after unloading})/\text{prestrain amount}\}\times 100$$

The results are shown in Table 2.

TABLE 2

| Sample No. | Superelasticity recovery ratio (@RT) (%) | Temperature dependency of stress (MPa/° C.) | Remarks |
|---|---|---|---|
| 1 | 96.5 | 0.45 | CE |
| 2 | 97.0 | 0.40 | " |
| 3 | 98.0 | 0.43 | " |
| 4 | 96.5 | 0.35 | " |
| 5 | 97.5 | 0.30 | This Inv. |
| 6 | 97.0 | 0.18 | " |
| 7 | 97.5 | 0.07 | " |
| 8 | 91.5 | −0.34 | " |
| 9 | 80.2 | −0.40 | " |
| 11 | 94.5 | −0.45 | " |
| 12 | 95.0 | 0.10 | " |
| 13 | 96.0 | 0.14 | " |
| 14 | 97.5 | 0.16 | " |
| 15 | 97.0 | 0.08 | " |
| 16 | 96.5 | 0.12 | " |
| 17 | 97.5 | 0.07 | " |
| 18 | 97.0 | 0.11 | " |

As is apparent from Table 2, the Fe-based shape memory alloy materials of the present invention (Nos. 5 to 18) all exhibited a superelasticity recovery ratio of higher than 80%, and the temperature dependency of stress was markedly low. On the other hand, the alloy materials of Comparative Examples (Nos. 1 to 4) had high shape recovery ratios; however, the alloy materials all had large temperature dependency.

Furthermore, in regard to Sample No. 7, a TEM photograph of a microstructure showing a dark field-viewing image from the (100) plane of a B2 ordered phase taken with TEM using a sample that had been subjected to an aging treatment for 60 minutes at 200° C., is shown in FIG. 1. The diagram on the lower left corner in FIG. 1 is a diffraction image (selected area diffraction pattern) of a BCC parent phase (or B2 precipitate) obtained when an electron beam was incident in the direction of (100)B2{[01-1]}. White dots in the dark field-viewing image of FIG. 1 represent the B2 phase. From FIG. 1, it is understood that fine BCC phases (B2 phases) have precipitated in the BCC parent phase (A2 parent phase). Furthermore, FCC precipitates exist in a small amount on the grain boundaries. It was confirmed by X-ray diffraction that in all of Sample Nos. 5, 6, and 8 to 18 of the alloy materials, a microstructure having such an A2+B2 structure was obtained.

Example 2

Furthermore, a solution-treated material of alloy material No. 7 produced in Example 1 was subjected to an aging treatment by varying the temperature and time of the aging treatment, and was subjected to a tensile test similar to that performed in Example 1 at RT (20° C., room temperature) only. The results obtained by measuring the superelasticity recovery strain of the solution-treated material are show in Table 3.

TABLE 3

| Aging conditions | | Superelasticity recovery ratio (@RT) |
|---|---|---|
| (° C.) | (min) | (%) |
| Without aging | | 56.0 |
| 100 | 60 | 85.2 |
| 150 | 45 | 88.6 |
| 150 | 60 | 95.0 |
| 200 | 45 | 97.0 |
| 200 | 60 | 95.4 |
| 250 | 30 | 94.5 |
| 250 | 60 | 93.2 |
| 300 | 15 | 94.5 |
| 300 | 30 | 90.2 |
| 350 | 5 | 86.5 |
| 350 | 15 | 83.2 |
| 400 | 15 | Breakage |

From Table 3, it was understood that when the alloy material is subjected to an aging treatment at 100° C. to 350° C. after a solution heat treatment, the alloy material exhibits satisfactory shape memory characteristics. On the other hand, at 400° C., since the aging temperature was too high, β-Mn was precipitated, to make the resultant alloy material embrittled. Thus, the alloy material was broken at a prestrain of about 1%. From the above results, it is understood that the aging temperature is preferably 100° C. to 350° C.

Example 3

Weight change was measured as an indicator of oxidation resistance, using TG-DSC. Regarding the test, the sample size was set to 1 mm×7 mm×7 mm, and in an air atmosphere, the sample was maintained at 900° C. for 24 hours. Thus, a mass increment (mg/mm$^2$) after heating with respect to the initial mass before heating was measured. The results are shown in Table 4.

TABLE 4

| | Sample No. | | | | | | | | | |
|---|---|---|---|---|---|---|---|---|---|---|
| | 1 | 2 | 3 | 4 | 5 | 6 | 7 | 8 | 9 | 10 |
| Cr (at %) | 0.0 | 1.0 | 2.0 | 3.0 | 5.1 | 5.4 | 7.5 | 10.0 | 12.5 | 15.0 |
| Mass increment (mg/cm$^2$) | 60.2 | 58.5 | 58.4 | 60.8 | 35.0 | 33.3 | 34.3 | 30.8 | 32.1 | 31.5 |
| Remarks | CE | " | " | " | This Inv. | " | " | " | " | " |

As is apparent from the results of Table 4, oxidation proceeded in Sample Nos. 1 to 4 of Comparative Examples. On the other hand, it was understood that oxidation was suppressed in Sample Nos. 5 to 10 of the present invention. Thereby, it is expected that the amount of Mn may not be decreased at high temperature, and fluctuation in the yield stress may be suppressed.

Example 4

The Fe-based alloy materials of Sample Nos. 101 to 110 as shown in Table 5 were produced in the same manner as in Example 1, except that the total time taken for the solution treatment was changed. In Table 5, it is shown that the composition is the same as the composition of the No. 7 alloy material. The grain size was regulated by changing the total time taken for the solution treatment. The dav/t (the ratio between the average grain size dav and the sheet thickness t) values of these alloy materials were as shown in Table 5. The average grain size dav was determined by averaging the grain sizes (the maximum length of a crystal) of 5 to 50 grains observed with an optical microscope. The shape memory characteristics [shape recovery ratio of superelasticity (SE)] of these alloy materials were measured in the same manner as in Example 1, except that the prestrain was set to 4%. The evaluation was made according to the following criteria: a case with a shape recovery ratio of lower than 60% was rated as D (poor); a case with a shape recovery ratio of 60% or higher and less than 80% was rated as B (good); and a case with a shape recovery ratio of 80% or higher was rated as A (excellent). The results are shown in Table 5.

TABLE 5

| Sample No. | Alloy composition | dav/t | Superelasticity recovery ratio (@RT) (%) |
|---|---|---|---|
| 101 | Sample No. 7 | 0.1 | D |
| 102 | Sample No. 7 | 0.3 | D |
| 103 | Sample No. 7 | 0.5 | D |
| 104 | Sample No. 7 | 1.0 | B |
| 105 | Sample No. 7 | 1.4 | B |
| 106 | Sample No. 7 | 2.3 | B |
| 107 | Sample No. 7 | 3.1 | B |
| 108 | Sample No. 7 | 5.2 | A |

TABLE 5-continued

| Sample No. | Alloy composition | dav/t | Superelasticity recovery ratio (@RT) (%) |
|---|---|---|---|
| 109 | Sample No. 7 | 8.6 | A |
| 110 | Sample No. 7 | 15.3 | A |

From Table 5, it was found that as the value of dav/t is larger, excellent superelasticity characteristics are obtained; and particularly, as the value of dav/t is 1 or greater, superior superelasticity is exhibited.

Example 5

Fe-based alloy materials having the composition shown in Table 6 were subjected to high-frequency melting, and wire materials of Nos. 201 to 210 were produced by means of forging, hot-grooved rolling, and cold-drawing. These wire materials were subjected to a solution treatment at 1,200° C. to obtain solution-treated materials, and the resultants were further subjected to an aging treatment at 200° C. for one hour to obtain aging-treated materials. Furthermore, the grain size was regulated by changing the total time taken for the solution treatment. The dav/R (the ratio between the average grain size dav and the radius R) values of these wire materials were as shown in Table 6. The average grain size dav was determined by averaging the grain sizes (the maximum length of a crystal) of 5 to 50 grains observed with an optical microscope. The shape memory characteristics were evaluated similarly to the case of the shape recovery ratio of superelasticity in Example 5. The results are shown in Table 6.

TABLE 6

| Sample No. | Alloy composition | dav/R | Superelasticity recovery ratio (@RT) (%) |
|---|---|---|---|
| 201 | Sample No. 7 | 0.1 | D |
| 202 | Sample No. 7 | 0.2 | D |
| 203 | Sample No. 7 | 0.5 | B |
| 204 | Sample No. 7 | 1.3 | A |
| 205 | Sample No. 7 | 1.9 | A |
| 206 | Sample No. 7 | 2.4 | A |
| 207 | Sample No. 7 | 3.2 | A |
| 208 | Sample No. 7 | 6.2 | A |
| 209 | Sample No. 7 | 9.2 | A |
| 210 | Sample No. 7 | 13.8 | A |

Note:
'dav' means an average grain size; and
'R' means a radius of a wire material.

When the dav/R value was 0.5 or greater, excellent superelasticity characteristics were exhibited. Furthermore, when the dav/R value was 1 or greater, especially superior superelasticity characteristics were exhibited. It was understood that a larger value of dav/R leads to superior shape memory characteristics.

Having described our invention as related to the present embodiments, it is our intention that the invention not be limited by any of the details of the description, unless otherwise specified, but rather be construed broadly within its spirit and scope as set out in the accompanying claims.

This application claims priority on Patent Application No. 2016-174142 filed in Japan on Sep. 6, 2016, which is entirely herein incorporated by reference.

REFERENCE SIGNS LIST

1 Fe-based alloy rod material (wire material) of this invention
10 grains
12 grain boundaries
dav average grain size
d grain size less than radius R
R radius of rod material (wire material)
2 Fe-based alloy sheet material (bar material) of this invention
20 grains
22 grain boundaries
dav average grain size
d grain size less than thickness T
T thickness of sheet material (bar material)
W width of sheet material (bar material)

The invention claimed is:

1. A Fe-based shape memory alloy material, containing 25 atom % to 42 atom % of Mn, 10.5 atom % to 11.5 atom % of Al, 5 atom % to 12 atom % of Ni, and 5.1 atom % to 15 atom % of Cr, with the balance being Fe and unavoidable impurities, in which a temperature dependency of a transformation-induced stress is 0.30 MPa/° C. or lower.

2. The Fe-based shape memory alloy material as claimed in claim 1, further containing at least one element selected from the group consisting of 0.1 atom % to 5 atom % of Si, 0.1 atom % to 5 atom % of Ti, 0.1 atom % to 5 atom % of V, 0.1 atom % to 5 atom % of Co, 0.1 atom % to 5 atom % of Cu, 0.1 atom % to 5 atom % of Mo, 0.1 atom % to 5 atom % of W, 0.001 atom % to 1 atom % of B, and 0.001 atom % to 1 atom % of C, at an amount of 15 atom % or less in total.

3. A method of producing the Fe-based shape memory alloy material as claimed in claim 1, the method including a step of performing a solution treatment at 1,100° C. to 1,300° C.

4. The method of producing the Fe-based shape memory alloy material as claimed in claim 3, further including a step of performing an aging treatment at 100° C. to 350° C. after the solution treatment step.

5. A wire material formed from the Fe-based shape memory alloy, material as claimed in claim 1, in which an average grain size of the Fe-based shape memory alloy material is greater than or equal to a radius of the wire material.

6. A sheet material formed from the Fe-based shape memory alloy material as claimed in claim 1, in which an average grain size of the Fe-based shape memory alloy material is greater than or equal to a thickness of the sheet material.

7. A Fe-based shape memory alloy material, containing 25 atom % to 42 atom % of Mn, 9 atom % to 13 atom % of Al, 5 atom % to 12 atom % of Ni, and 6.0 atom % to 12.0 atom % of Cr, with the balance being Fe and unavoidable impurities, in which a temperature dependency of a transformation-induced stress is 0.30 MPa/° C. or lower.

8. A Fe-based shape memory alloy material, containing 25 atom % to 42 atom % of Mn, 10.5 atom % to 11.5 atom % of Al, 5 atom % to 12 atom % of Ni, and 6.0 atom % to 12.0 atom % of Cr, with the balance being Fe and unavoidable impurities, in which a temperature dependency of a transformation-induced stress is 0.30 MPa/° C. or lower.

* * * * *